US005123687A

United States Patent [19]

Pfeiffer et al.

[11] Patent Number: 5,123,687

[45] Date of Patent: Jun. 23, 1992

[54] GRIP CONTROL FOR A HANDLE FOR UNLOCKING VEHICLE DOORS

[75] Inventors: Peter Pfeiffer, Böblingen; Gerhard Honer, Weil der Stadt, both of Fed. Rep. of Germany; Gerald Herzl, British Columbia, Canada

[73] Assignee: Mercedes-Benz AG, Fed. Rep. of Germany

[21] Appl. No.: 648,288

[22] Filed: Feb. 1, 1991

[30] Foreign Application Priority Data

Feb. 1, 1990 [DE] Fed. Rep. of Germany ..... 4002963

[51] Int. Cl.[5] ..... E05C 3/26

[52] U.S. Cl. ..... 292/336.3; 292/DIG. 31; 292/DIG. 62

[58] Field of Search ..... 292/DIG. 62, DIG. 31, 292/336.3, DIG. 23; 70/208

[56] References Cited

U.S. PATENT DOCUMENTS

| | | | |
|---|---|---|---|
| 2,117,192 | 5/1938 | McClung | 292/DIG. 31 |
| 2,218,960 | 10/1940 | Rightmyer | 292/DIG. 31 |
| 3,020,075 | 2/1962 | Johnstone et al. | 292/DIG. 31 |
| 3,858,921 | 1/1975 | Kuki | 292/336.3 |
| 3,967,844 | 7/1976 | Torii et al. | 292/336.3 |
| 3,993,338 | 11/1976 | Cherbourg et al. | 292/DIG. 31 |
| 3,993,339 | 11/1976 | Cherbourg et al. | 292/336.3 |
| 4,475,754 | 10/1984 | Arlavskas et al. | 292/336.3 |
| 4,482,179 | 11/1984 | Johnson | 292/336.3 |
| 4,588,219 | 5/1986 | Kobayashi et al. | 292/DIG. 31 |

FOREIGN PATENT DOCUMENTS

| | | |
|---|---|---|
| 0072537 | 2/1983 | European Pat. Off. . |
| 3403003 | 1/1986 | Fed. Rep. of Germany . |

*Primary Examiner*—Eric K. Nicholson

*Attorney, Agent, or Firm*—Evenson, Wands, Edwards, Lenahan & McKeown

[57] ABSTRACT

A grip control for a handle for unlocking vehicle doors, which handle in a rest position can be retracted flush with an outer contour in a recess of the vehicle door. The handle can be moved in a controlled manner out of the recess into a ready position for opening the vehicle door. Subsequently, the handle can be pivoted out further counter to a spring force with actuation of a lock unlocking device. The grip control includes two pivot levers which are articulated at one side fixed to the door, and on the other side are connected in an articulated manner to the handle. When the pivot levers are pivoted in a controlled manner, they displace the handle into a ready position parallel with the outer contour of the door, and they then permit an additional pivoting-out movement of a side of the grip counter to the force of a spring.

7 Claims, 2 Drawing Sheets

GRIP CONTROL FOR A HANDLE FOR UNLOCKING VEHICLE DOORS

BACKGROUND AND SUMMARY OF THE INVENTION

The invention relates to a grip control for a handle for unlocking vehicle doors, which handle in a rest position can be retracted flush with an outer contour in a recess of the vehicle door, and can be moved in a controlled manner out of the recess by means of a control mechanism into a ready position for opening the vehicle door, and can subsequently be pivoted out further counter to a spring force with actuation of a lock unlocking device.

A known grip control, as described in German Patent Specification 3,403,003, makes it possible to retract a handle of a motor vehicle door in a controlled manner into a rest position inside a door plane, and to move it out of this position into a ready position, ready to be gripped, outside the outer contour of the door. To this end, the handle is pivoted at one side about a bearing bolt in such a way that an open space is produced relative to the door at the opposite end of the handle, which open space enables the handle to be gripped. The handle can be pivoted further outwards from this ready position, a lock release lever being actuated which unlocks a door lock. A pivoting out of a handle from the door recess on only one side requires, however, a large-angle pivoting movement about the bearing bolt since an access area for a hand must be provided which is as wide as possible. As a result, the guides for the handle also project a long way in the transverse direction inside the door, which hinders the accommodation of further units in the door. However, if these extended dimensions of the handle cannot be realized inside the door, then the recess must be widened in such a way that a hand gripping the handle still has enough room in the recess, as a result of which, however, it is no longer possible to provide a dirt-free arrangement.

A handle for unlocking a vehicle door is described in European Patent Specification 0,072,537 which, in a rest position, lies flush with an outer contour, retracted in a recess of the vehicle door, and can be pivoted in this position about a longitudinal axis of the grip. It can be pivoted out further from this position counter to a spring force with actuation of a lock unlocking device. A controlled movement of the handle out of the recess into a ready position is not provided here.

An object of the invention is to provide a handle of the above-noted generic type with a grip control, by means of which this device can be retracted into a door, with good operability of the handle with a small installation depth.

This object is achieved according to the invention by providing an arrangement wherein the grip control comprises two pivot levers which are respectively articulated at one side at fixed positions at the door, and on the other side are connected in an articulated manner to the handle, said pivot levers including means to displace the handle into a ready position parallel with the outer contour of the door when they are pivoted in a controlled manner, said pivot levers further including means permitting an additional pivoting-out movement of an articulated handle side counter to the force of a spring from said ready position.

The displacement of the handle at both sides and a ready position parallel with the outer contour of the door enable a hand to engage a long way behind the moved-out handle without there being any need for the guides for the handle to extend a very long way inside the door because of the short displacement travel.

At the same time, it is also not necessary to provide a recess behind the handle for the hand, so that in this design technical advantages in terms of accommodating pulling of the handle also result from a recess with only a small depth.

The grip control can be realized in such a way that, in the event of the displacement of the handle from its recessed rest position into the ready position outside the outer contour of the door, the lock unlocking device of the vehicle door is not yet actuated, and the unlocking mechanism permits this displacement of the handle, while the lock unlocking device is subsequently to be released by the handle.

By connecting the pivot levers to each other and to a conventional control mechanism via a coupling rod, a wide variety of possibilities are provided for effecting inward and outward movement of the handle. Since the recess in the door can be matched in terms of its depth and contour to the dimensions of the handle, the recess and the sides of the handle can be kept free of dirt by the retracting of the handle.

Other objects, advantages and novel features of the present invention will become apparent from the following detailed description of the invention when considered in conjunction with the accompanying drawings.

DETAILED DESCRIPTION OF THE DRAWINGS

Figure 1:
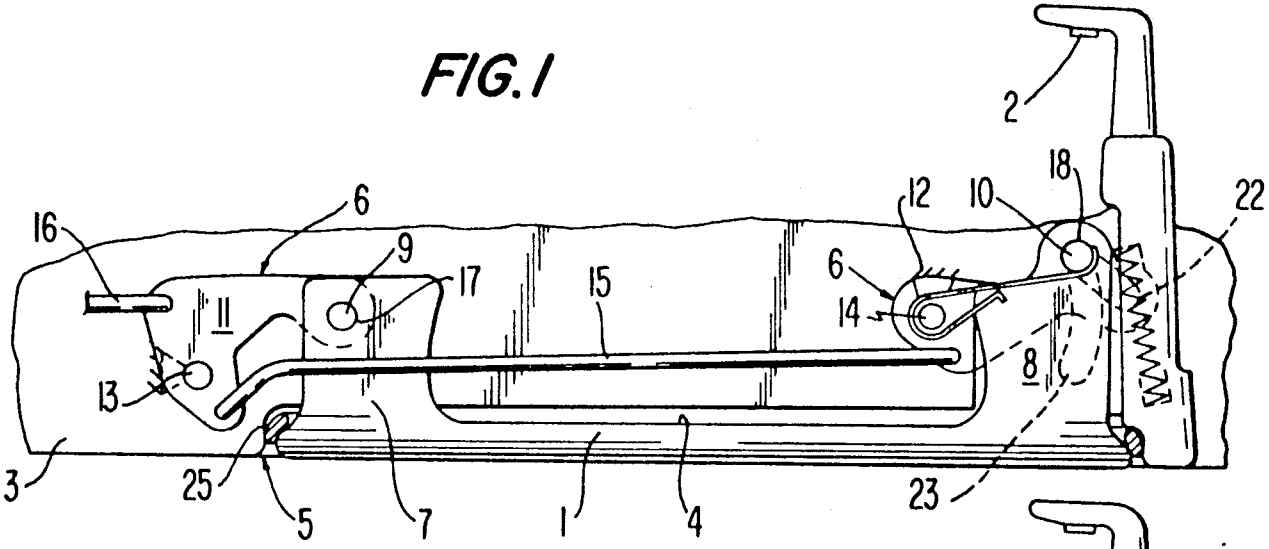
FIG. 1 is a schematic top view of a handle of a vehicle door in the retracted rest position, constructed according to a preferred embodiment of the invention.

FIG. 1 shows a handle 1 with which a lock unlocking device of a vehicle door 3 can be actuated, and this vehicle door 3 pivoted open and closed. During the time for which it is not required, the handle 1 is to be retracted into a recess 4 in the vehicle door 3 so that it cannot cause injuries and so that it does not become dirty, and a person opening the door therefore does not soil his fingers.

In order to make it possible to control this movement of the handle 1 from a retracted rest position into a ready position projecting from an outer contour 5 of the door, and back again, the handle i is provided with a grip control 6 in which each side 7 and 8 of the handle 1 is connected to respective pivot levers 11 and 12 at respective articulation points 9 and 10. The pivot levers 11 and 12 are in turn rigidly secured in the vehicle door 3, each with a pivot bolt 13 and 14 respectively, which form the respective pivot pins of the pivot levers 11, 12.

The pivot levers 11, 12 are connected via a linkage part 15, and a coupling rod 16 is articulated on one of the pivot levers 11 so that a control movement of the coupling rod 16 causes a pivot movement of the pivot lever 11, which effects, via the linkage part 15, an identical pivoting of the second pivot lever 12, as a result of which the handle 1 is displaced with both sides 7, 8 in the same direction. The coupling rod 16 can be moved by conventional control elements.

Figure 2:
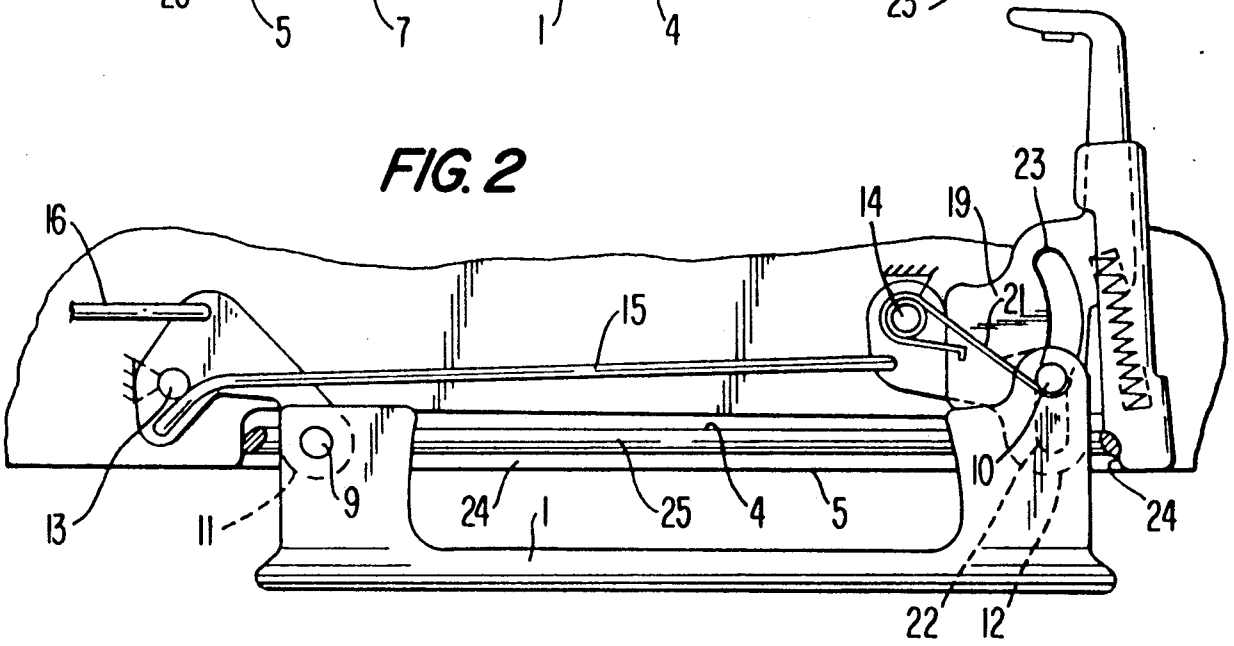
FIG. 2 shows this handle of FIG. 1 in a moved-out ready position.
Figure 3:
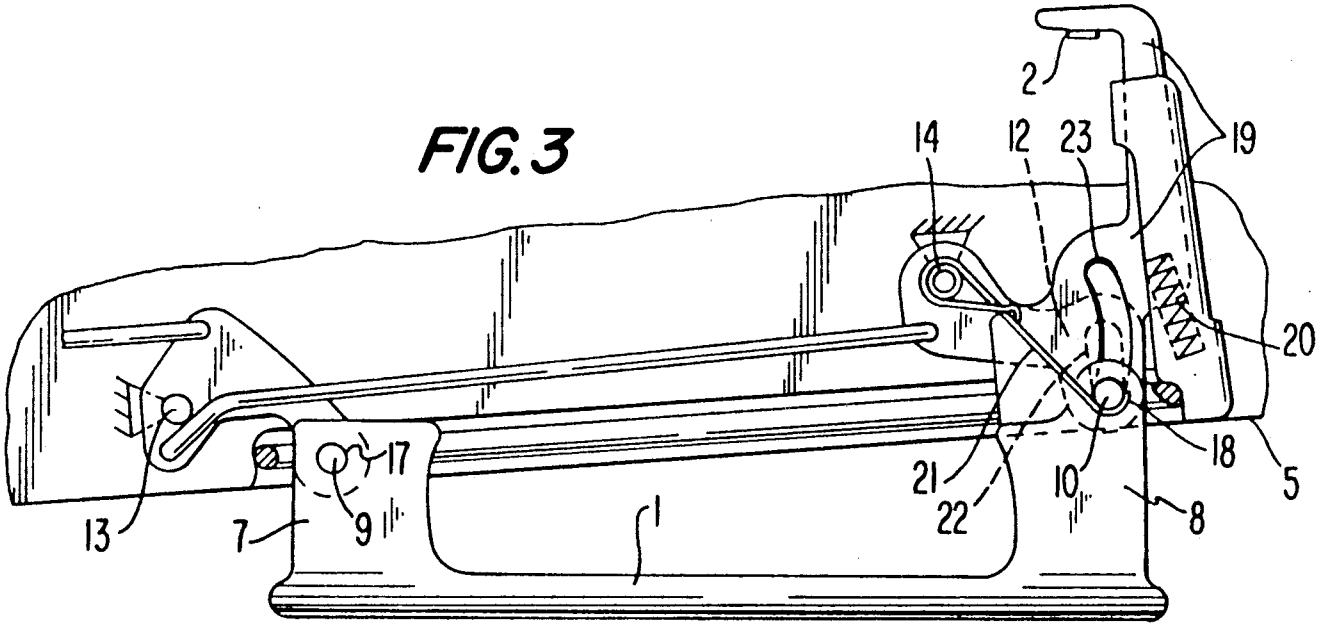
FIG. 3 shows the handle of FIGS. 1 and 2 pivoted further outwards with actuation of a lock unlocking device.

The handle 1 lies parallel to the outer contour 5 of the door in the ready position of FIG. 2 so that a hand taking hold of the handle finds a large open space available in order to grip the handle 1. The handle 1 can be pivoted further out to the position shown in FIG. 3 from this ready position of FIG. 2 with the side 7 of the handle I pivoting about a bolt 17 in the articulation point 9, while the outer side 8 of the handle 1 is displaced relative to its pivot lever 12 and is moved even further away from the outer contour 5 of the door. Side 8 of the grip pulls a dog 19 with it via a bolt 18 in the articulation point 10, which thus actuates the lock unlocking device 2 and tensions two springs 20 and 21.

The movement of this side 8 of the grip relative to its pivot lever 12 is made possible by an elongated hole guide 22 in this pivot lever 12. As long as the handle 1 is not pulled from outside, the spring 21, which is secured by one end to the pivot lever 12, retains the handle 1 in an innermost position on the pivot lever 12.

The displacement of the handle 1 out of the rest position into the ready position without actuation of the lock unlocking device is achieved by a slot guide 23 in the dog 19, which permits an unhindered pivoting movement of the bolt 18 into the ready position. By virtue of this displacement of the handle 1 outside the outer contour 5 of the door in a manner favorable to access, there is no need for an additional deepening of the recess 4 for the hand gripping the handle, and the contour 24 of the grip recess can be matched closely to the dimensions of the handle. The transition from the contour of the grip recess to the retracted handle I via an intermediate seal 25 is therefore designed in a particularly sealing manner with respect to dirt and penetration of water.

A control can be provided which, after a crash pulse occurs, transfers the handle 1, via the triggering of the pivot levers 11, 12, into the ready position.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. Grip control for a handle for unlocking vehicle doors, which handle in a rest position can be retracted flush with an outer contour in a recess of the vehicle door, and can be moved in a controlled manner out of the recess by means of a control mechanism into a ready position for opening the vehicle door, and can subsequently be pivoted out further counter to a spring force with actuation of a lock unlocking device, wherein the grip control comprises two pivot levers which are respectively articulated at one side at fixed positions at the door, and on the other side are connected in an articulated manner to the handle, said pivot levers including means to displace the handle into a ready position parallel with the outer contour of the door when they are pivoted in a controlled manner, said pivot levers further including means permitting an additional pivoting-out movement of an articulated handle side counter to the force of a spring from said ready position.

2. Grip control according to claim 1, wherein the pivot levers include means to effect a parallel displacement of the handle by virtue of the arrangement of the articulation points of the sides of the grip relative to the pivot pins of the pivot levers.

3. Grip control according to claim 1, wherein a dog of the lock unlocking device has a slot guide which permits an unhindered displacement of the handle and pivoting movement of the lever connected thereto out of the rest position into the ready position.

4. Grip control according to claim 2, wherein a dog of the lock unlocking device has a slot guide which permits an unhindered displacement of the handle and pivoting movement of the lever connected thereto out of the rest position into the ready position.

5. Grip control according to claim 1, wherein the pivot levers are effectively connected via a linkage part, and wherein one of the pivot levers is subject to the action of a coupling rod which effects a positively controlled inward and outward movement of the handle.

6. Grip control according to claim 2, wherein the pivot levers are effectively connected via a linkage part, and wherein one of the pivot levers is subject to the action of a coupling rod which effects a positively controlled inward and outward movement of the handle.

7. Grip control according to claim 1, wherein the contour of the grip recess completely surrounds the retracted handle.

* * * * *